United States Patent [19]

Herron

[11] Patent Number: 4,901,651

[45] Date of Patent: Feb. 20, 1990

[54] SECRET REPOSITORY

[76] Inventor: James R. Herron, 57 Bluebird La., Naperville, Ill. 60565

[21] Appl. No.: 361,425

[22] Filed: Jun. 5, 1989

[51] Int. Cl.[4] ..... E05G 01/00

[52] U.S. Cl. ..... 109/54; 70/DIG. 81; 312/204

[58] Field of Search ..... 109/45, 49, 53, 54, 109/56, 23, 50, 51; 312/204; 70/85, 86, DIG. 81

[56] References Cited

U.S. PATENT DOCUMENTS

| | | | |
|---|---|---|---|
| 375,574 | 12/1887 | Shannon | 109/54 |
| 513,061 | 1/1894 | Slater | 312/204 |
| 538,954 | 5/1895 | Eastman | 109/54 |
| 3,899,983 | 8/1975 | Hernandez | 109/54 |
| 4,030,426 | 6/1977 | Lyons | 109/51 |
| 4,083,314 | 4/1978 | Garvin | 109/50 |
| 4,113,332 | 9/1978 | McMaster | 312/204 |
| 4,172,424 | 10/1979 | DePalau | 109/54 |
| 4,244,303 | 1/1981 | Xurasik | 109/23 |

*Primary Examiner*—Robert L. Wolfe
*Attorney, Agent, or Firm*—Donald J. Breh

[57] ABSTRACT

A secret repository for use with a desk drawer or the like is disclosed. The repository includes a receptacle having a peripherial boundary not exceeding the peripheral boundary of a rear panel of the drawer and attachment members in the form of hook-like members engagable over an edge of the panel or double sided adhesive members for removably attaching the receptacle to the drawer rear panel disposed adjacent an external surface of the panel.

11 Claims, 1 Drawing Sheet

SECRET REPOSITORY

BACKGROUND OF THE INVENTION

This invention relates to repositories and more particularly to a hidden or secret repository. In still greater particularity, the invention relates to a secret repository easily and removably mountable to a panel such as to the back side of a desk or cabinet drawer.

Secret repositories for holding valuable items are known. Representative devices are disclosed in U.S. Pat. Nos. 4,244,303, 4,083,314, 4,113,332, 4,030,426 and 375,579. In particular, those repositories disclosed in U.S. Pat. Nos. 4,113,332 and 4,030,426 are typical of the type wherein the security or hidden repository is associated with a drawer of a desk or cabinet. Those repositories involve rather extensive modification to the structure of the drawer and or complicated mounting and locking means.

SUMMARY OF THE INVENTION

The present invention provides for a portable, simply constructed repository adapted to be secretly mounted behind a panel and in particular to the external side of the back panel of a desk or cabinet drawer where the repository is not visible to one who may open the drawer.

According to the invention, the repository includes a receptacle having means for mounting the receptacle to the external side of the back panel of a drawer.

According to an important feature of the invention, the receptacle is mountable such that the upper boundary of the receptacle does not extend above the upper edge of the drawer rear panel and thus remains essentially undetectable when the drawer is opened.

According to the invention, the mounting means is removable and comprises at least one generally hooked-shaped member secured to the container and engagable over the upper edge of the rear panel of the drawer.

Alternatively, the mounting means comprises at least one adhesive member on the receptacle.

A still further important feature of the invention provides for the receptacle size and peripheral boundary not to extend beyond the limits of the size and shape of the peripheral boundary of the drawer rear panel.

Another very important feature of the invention provides for the receptacle to be an expandable envelope-like member.

BRIEF DESCRIPTION OF THE DRAWINGS

The invention will be better understood after reading the following Detailed Description of the Preferred Embodiment in conjunction with the Drawings of which.

DETAILED DESCRIPTION OF THE PREFERRED EMBODIMENT

Figure 1:
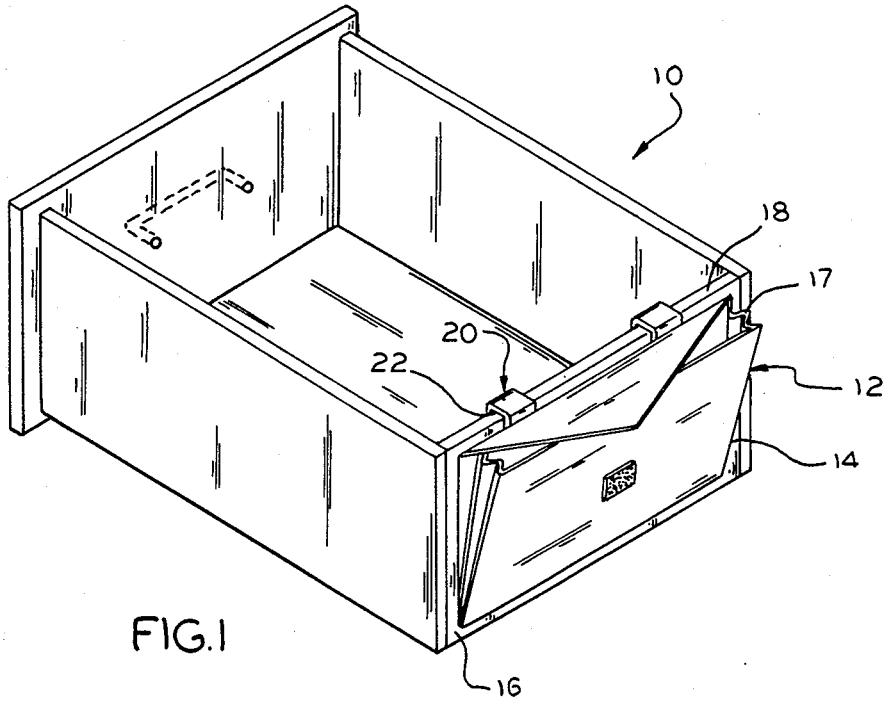
FIG. 1 is a pictorial view of a drawer taken toward the external rear surface of a rear panel of the drawer showing a repository according to the invention mounted to the drawer.

Shown in FIG. 1 is a typical drawer 10 of the type commonly used in a desk or cabinet, not shown. Advantageously, most common drawers 10 do not require any modification to allow use of the repository of the present invention.

Figure 2:
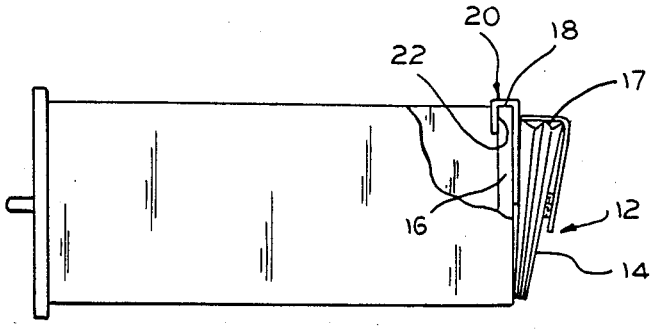
FIG. 2 is a side view of the drawer in FIG. 1 with a portion of a sidewall cut away showing details of construction and mounting of the repository.

As shown in FIGS. 1 and 2, the secretly mountable repository 12 includes a receptacle 14 which can take many forms including, for example, an accordian, pleated or otherwise expandable-type envelope as shown in the drawings, a non-expandable envelope, pouch or a rigid container if desired. The primary requirement is that preferably the peripheral boundary of the container not extend beyond the peripheral boundary of the rear panel 16 so that, first, the receptacle will not interfere with the operation of the drawer on which it is used or any adjacent drawer of the desk or cabinet and also so as to minimize its visibility and the likelihood of detection when the drawer is opened.

Figure 3:
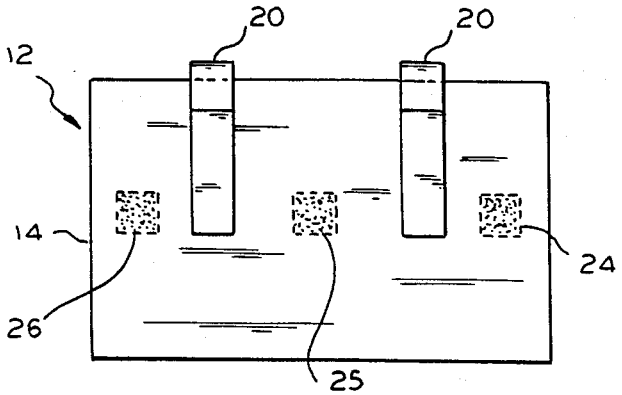
FIG. 3 is a side view of the repository showing details of construction and an alternative mounting means.
Figure 4:
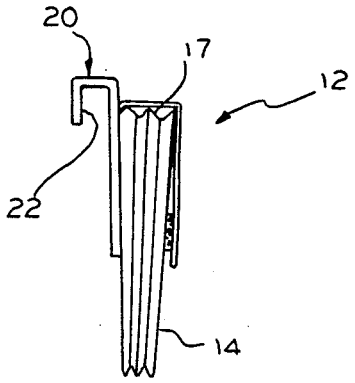
FIG. 4 is an end view of the repository showing further details of construction.

Preferably, the upper boundary 17 of the receptacle should not extend higher than the upper edge 18 of the rear panel 16. The receptacle is removably mountable to the rear panel 16 by way of at least one and preferably a pair of mounting members 20 attached to one side of the receptacle where each member has a hooked-shaped end 22 receivable over the upper edge 18 of the rear panel 16. Alternatively, the removable attachment of the receptacle 14 to the rear panel 16 can be effected by way of at least one but preferably more than one double sided adhesive member such as members 24, 25, 26 provided on one surface of the receptacle as shown in dashed outline in FIG. 3.

It can be seen that, in use, the repository is attached to the rear panel of the drawer after the article(s) to be hidden are placed in the receptacle and that the receptacle is disposed behind the rear panel of the drawer and out of view by anyone who pulls the drawer open. This is especially true since typically most drawers are pulled only partially open.

The repository can be easily removed for access to the contents or for removal to another drawer. The repository is mountable on many different size drawers without modification to either the drawer or repository and is therefore very versatile.

It should be noted that the invention lends itself to be constructed from many different popular and common materials each having their own advantages such as metal, plastics, paperboard or even fabric or different combinations of such materials and those skilled in the art having the benefit of this disclosure can readily devise other embodiments and modifications which are to be considered to be within the scope of the appended claims.

What is claimed is:

1. A secret repository for attachment to a drawer or the like comprising:

a receptacle: and means for removably attaching said receptacle to a rear vertical panel of said drawer or the like positioned adjacent an external surface of said rear vertical panel behind said drawer or the like.

2. The repository as defined in claim 1 wherein said means for attaching comprises an adhesive member on said receptacle.

3. The repository as defined in claim 2 wherein said receptacle is an envelope-like member.

4. The repository as defined in claim 3 wherein said receptacle is an expandable envelope-like member.

5. The repository as defined in claim 1 wherein said means for removably attaching comprises at least one attachment member affixed to said receptacle including means adapted to engage an upper edge of said rear vertical panel.

6. The repository as defined in claim 5 wherein said at least one attachment member comprises a hook-shaped member.

7. The repository as defined in claim 1 wherein said receptacle has a shape and size such that the peripheral boundary of the receptacle falls within the peripheral boundary of a predetermined size and shape of said rear vertical panel.

8. A secret repository for removable attachment to a drawer or the like comprising:

a receptacle having an upper boundary in an attached position of the receptacle to a rear vertical panel of the door or the like disposed adjacent an external surface of the rear vertical panel behind said door or the like; and at least one attachment member affixed to said receptacle adapted to removably attach said receptacle to said rear vertical panel in the attached position with said upper boundary not higher than an upper edge of the rear vertical panel.

9. The repository as defined in claim 8 wherein said receptacle is an envelope-like member and said at least one attachment member is an adhesive member on one surface of said envelope-like member.

10. The repository as defined in claim 8 wherein said at least one attachment member is at least one member attached to said receptacle having a generally hooked-shaped portion adapted to engage over the upper edge of the rear vertical panel.

11. The repository as defined in claim 10 wherein said receptacle is a pleated expandable, envelope-like member and said at least one attachment member is affixed to a surface of said exandable, envelope-like member.

* * * * *